US006516757B2

(12) United States Patent
Aoyama et al.

(10) Patent No.: US 6,516,757 B2
(45) Date of Patent: Feb. 11, 2003

(54) INTERNAL COMBUSTION ENGINE WITH A SUPERCHARGER AND AN IMPROVED PISTON CRANK MECHANISM

(75) Inventors: Shunichi Aoyama, Kanagawa (JP); Takayuki Arai, Yokohama (JP); Katsuya Moteki, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/870,741

(22) Filed: Jun. 1, 2001

(65) Prior Publication Data

US 2001/0047778 A1 Dec. 6, 2001

(30) Foreign Application Priority Data

Jun. 2, 2000 (JP) ..... 2000-165528

(51) Int. Cl.[7] ..... F02B 75/04
(52) U.S. Cl. ..... 123/78 R
(58) Field of Search ..... 123/195 A, 196 R, 123/41.08, 78 R

(56) References Cited

U.S. PATENT DOCUMENTS 6,202,623 B1 * 3/2001 Ehrlich ..... 123/197.4

FOREIGN PATENT DOCUMENTS

JP 62-78440 4/1987

* cited by examiner

*Primary Examiner*—Willis R. Wolfe
*Assistant Examiner*—Katrina B. Harris
(74) *Attorney, Agent, or Firm*—Foley & Lardner

(57) ABSTRACT

A supercharged internal combustion engine is provided with a double-link type piston crank mechanism connecting between a piston and a crankshaft. The piston crank mechanism causes the piston to move at a speed which is smaller around a top dead center (TDC) and larger around a bottom dead center (BDC) as compared with respective corresponding piston speeds attained by a comparable single-link type piston crank mechanism. The double-link type piston crank mechanism variably controls a compression ratio by varying an angular position of one of links constituting the piston crank mechanism.

19 Claims, 4 Drawing Sheets

INTERNAL COMBUSTION ENGINE WITH A SUPERCHARGER AND AN IMPROVED PISTON CRANK MECHANISM

BACKGROUND OF THE INVENTION

The present invention relates to an internal combustion engine with a supercharger disposed in an intake system and more particularly to a supercharged internal combustion engine of a reciprocating piston type having an improved piston crank mechanism which can optimize the piston speed when the engine is in a supercharged condition and can vary the compression ratio in accordance with an operating condition of the engine.

An example of a supercharged internal combustion engine of a reciprocating piston type having a variable compression ratio mechanism is disclosed in Japanese Patent Provisional Publication No. 62-78440. It is disclosed in the publication to make lower the compression ratio at high load operation where supercharging is carried out, for thereby avoiding knocking, and make higher the compression ratio at low to middle load operation where supercharging is not carried out, for thereby attaining a good fuel consumption. The variable compression ratio mechanism variably controls the compression ratio through a variable control of the volume of a chamber in communication with an engine cylinder, which is attained by varying a position of a piston disposed in the chamber.

SUMMARY OF THE INVENTION

Generally, at high load operation where a large amount of air-fuel mixture is to be combusted, the burn duration tends to become longer. This tendency is enhanced when supercharging is carried out at high load operation, resulting in a problem that the exhaust gas temperature at high load operation becomes very high.

When the burn duration becomes longer, the combustion is not completed within a crank angle range (the first half of the expansion stroke) where the heat of the combustion can be effectively converted to the output of the engine. Accordingly, the heat generated at the latter period of the combustion is not effectively converted to the output of the engine but is used only for increasing the temperature of the exhaust gas, thus lowering the thermal efficiency of the engine and causing a high exhaust gas temperature at high load.

For this reason, in an internal combustion engine with a supercharger, it is required that a material having a high heat resistance be used for the parts around the combustion chamber and the parts of the exhaust system or the amount of fuel be increased considerably at high load where the engine is operated under a highly or sufficiently supercharged condition, for thereby lowering the exhaust gas temperature.

It is accordingly an object of the present invention to provide an internal combustion engine equipped with a supercharger, which is free from the above noted problems.

It is a further object of the present invention to provide an internal combustion engine of the foregoing character which can shorten the burn duration at high load operation, thereby prevent a rise of the exhaust temperature and improve the thermal efficiency of the engine.

It is a further object of the present invention to provide an internal combustion engine of the foregoing character which can variably control the compression ratio in accordance with a supercharging pressure, thereby prevent knocking when supercharging pressure is high and improve the fuel consumption when supercharging is not carried out.

To accomplish the above objects, the present invention provides an internal combustion engine comprising a piston reciprocatively movable within a cylinder of the engine, a piston crank mechanism for converting reciprocative motion of the piston to rotation of a crank shaft, and a supercharger for supercharging the cylinder, wherein the piston crank mechanism connects between the piston and the crankshaft so as to cause the piston to move at a speed which is lower around a top dead center of the piston and higher around a bottom dead center of the piston as compared with respective corresponding speeds attained by a comparable single-link type piston crank mechanism.

DESCRIPTION OF THE PREFERRED EMBODIMENTS

Figure 1:
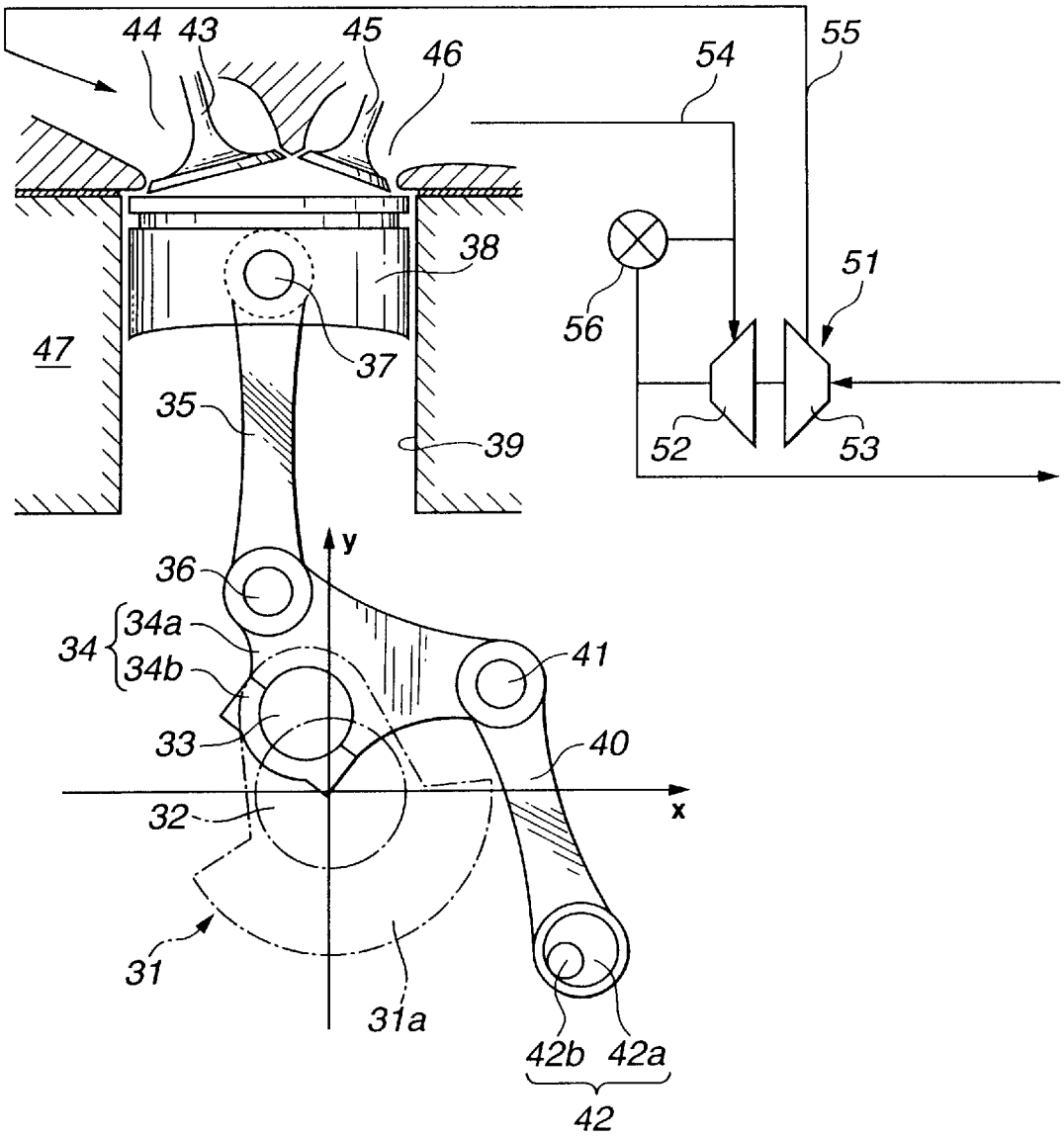
FIG. 1 is a schematic view of an internal combustion engine having a double-link type piston crank mechanism according to an embodiment of the present invention.

Referring first to FIG. 1, an internal combustion engine with a double-link type piston crank mechanism will be described. The double-link type piston crank mechanism is constructed to attain an optimum piston speed when the engine is in a supercharged condition, which will be understood when the description proceeds further. In addition to this, the double-link type piston crank mechanism has a function of varying a compression ratio of the engine, i.e., also functions as a variable compression ratio mechanism. The piston crank mechanism includes crank shaft 31 having a plurality of journal portions 32, a plurality of crank pins 33 and a plurality of counter weight portions 31*a*. On main bearings (not shown) installed on cylinder block 47 constituting part of a main body of the engine are rotatably supported journal portions 32. Crank pins 33 are offset from journal portions 32 by a predetermined amount. To crank pins 33 are swingably or pivotally connected lower links 34 serving as second links.

Lower link 34 is nearly T-shaped and includes main body 34*a* and cap 34*b* which are separable. Nearly at a central portion of lower link 34 and between main body 34*a* and cap 34*b* is formed a connecting hole in which crank pin 33 is fitted.

Upper link 35 serving as a first link is pivotally connected at a lower end to one end of lower link 34 by means of connecting pin 36 and at an upper end to piston 38 by means of piston pin 37. Piston 38 is subjected to a combustion pressure and reciprocates within cylinder 39 of cylinder block 47.

Above cylinder 39 are disposed intake valve 43 that opens and closes intake port 44 in a timed relation to revolution of crankshaft 31 and exhaust valve 45 that opens and closes exhaust port 46 in timed relation to revolution of crankshaft 31.

Control link 40 that serves as a third link is pivotally connected at an upper end to the other end of lower link 34 by means of connecting pin 41 and at a lower end to the engine main body such as cylinder block 47 by way of control shaft 42. More specifically, control shaft 42 has larger diameter portion 42*a* to which the lower end of control link 40 is pivotally connected. Control shaft 42 further has smaller diameter portion 42*b* which is eccentric with larger diameter portion 42*a* and at which it is pivotally supported on the engine main body. Control shaft 42 and the engine main body constitute a variable pivot device for varying a pivotal position at which control link 40 or third link is pivotally connected to the engine main body.

Rotational position of control shaft 42 is controlled by a control system. The control system is constructed so as to be capable of holding control shaft 42 at a desired rotational position against a reaction force which is applied to control shaft 42 from control link 40. The control system will be described more in detail hereinlater.

In the above described piston crank mechanism, when control shaft 42 is caused to rotate under the control of the control system, the center axis of larger diameter portion 42*a* which is eccentric with smaller diameter portion 42*b* is caused to vary relative to the engine main body. By this, the position where control Link 40 is pivotally supported relative to the engine main body is caused to vary. This in turn causes a variation in the stroke of piston 38, thus causing the position of piston 38 at the top dead center (TDC) to become higher or lower, i.e., the y-coordinate of the TDC in the graph of FIG. 1 to become higher or lower, thus making it possible to attain a variation of the compression ratio of the engine.

The internal combustion engine is equipped with turbocharger 51 which serves as a supercharger. Turbocharger 51 includes turbine 52 disposed in exhaust passage 54 and compressor 53 disposed in intake passage 55 and coaxially with turbine 52. In order to control the supercharging pressure in accordance with the operating conditions of the engine, there is provided exhaust bypass valve 56 for allowing part of the exhaust gas to bypass turbine 52.

Figure 2:
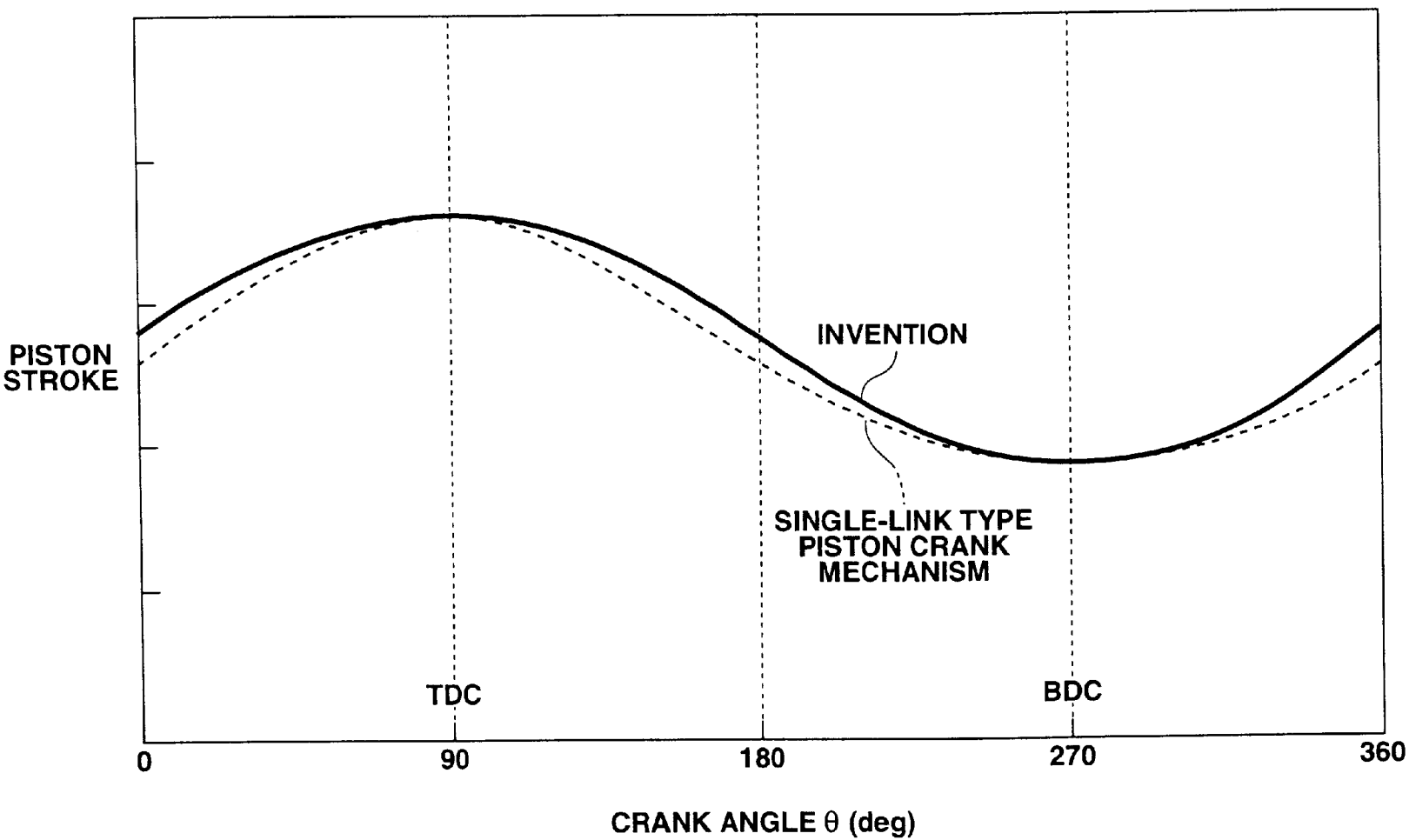
FIG. 2 is a graph showing piston stroke characteristics of the double-link type piston crank mechanism of FIG. 1.

The solid line curve in FIG. 2 represents the piston stroke characteristics of the double-link type piston crank mechanism in FIG. 1. The dotted line curve represents the piston stroke characteristics of an ordinary single-link type piston crank mechanism, i.e., a piston crank mechanism wherein a piston pin and a crank pin is connected by a single link (connecting rod). With the ordinary single-link type piston crank mechanism, the speed of the piston around the TDC is sure to be larger than that around a bottom dead center (BDC). Such a difference in piston speed can be made smaller by making the connecting rod longer. This resultantly makes it possible to make smaller the speed of the piston around the TDC. However, in this instance, there is caused a problem that the height of the engine (i.e., the distance between the center of the crankshaft to the upper end of the cylinder) is increased. In contrast to this, with the double-link type piston crank mechanism, the piston speed can be made smaller around the TDC and larger around the BDC by adjusting the interrelation or connections of the links, without varying the height of the engine. In the piston crank mechanism of FIG. 1 which is structured as described above, the piston speed is smaller around the TDC and larger around the BDC as compared with respective corresponding piston speeds attained by a comparable single-link type piston crank mechanism. FIG. 2 shows the piston stroke characteristics of the double-link type and single-link type piston crank mechanisms on the condition that the stroke of the piston and the height of the engine are nearly the same in the two mechanisms.

The solid line curve in FIG. 2 represents an example of piston stroke characteristics under a low compression ratio condition which is used at high supercharging operation (high load operation). The piston speed under a high compression ratio condition is a little larger adjacent the TDC and a little smaller adjacent the BDC than that shown in FIG. 2.

Figure 3:
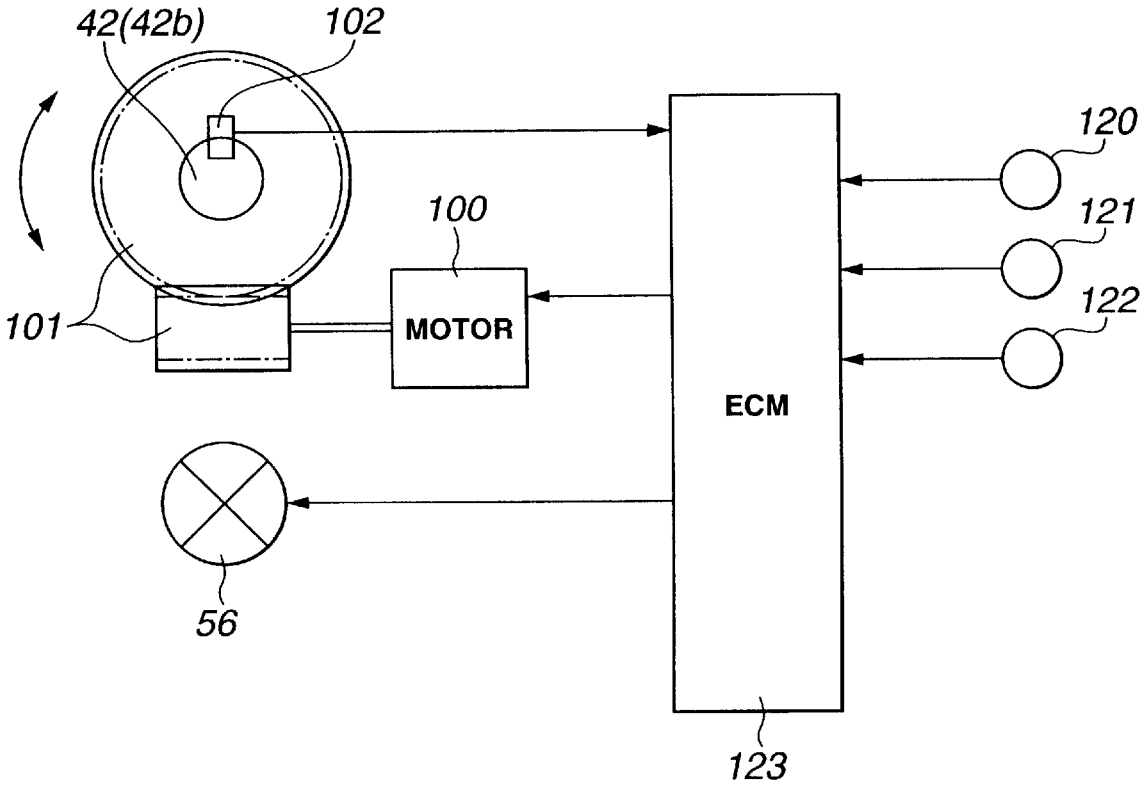
FIG. 3 is a schematic view of a control system for controlling a variable compression ratio mechanism and an exhaust bypass valve of FIG. 1.

Referring to FIG. 3, a control system for controlling the variable compression ratio mechanism (double-link type piston crank mechanism) and an exhaust bypass valve 56 will be described. The control system shown in FIG. 3 includes an electric motor 100 which is drivingly connected to gearing 102 for controlling the rotation angle of control shaft 42 by way of gearing 102. Specifically, gearing 101 includes a worm (no numeral) connected to a rotation shaft of motor 100 and a worm wheel (no numeral) meshed with the worm and drivingly connected to control shaft 42. The rotation angle of control shaft 42 is detected by rotation angle sensor 102. The supercharging pressure in an intake system, which is produced by turbo charger 51, is detected by supercharging pressure sensor 122. Motor 100 is controlled by an engine control module (ECM) 123. Inputted to engine control module 123 are an accelerator pedal opening degree signal from accelerator pedal opening degree sensor 120 and an engine speed signal from engine speed sensor 121. On the basis of those signals, engine control module 123 calculates a target rotation angle of control shaft 42 and a target supercharging pressure and supplies control signals representative of a calculated target rotation angle and a calculated target supercharging pressure to motor 100 and exhaust bypass valve 56.

Figure 4:
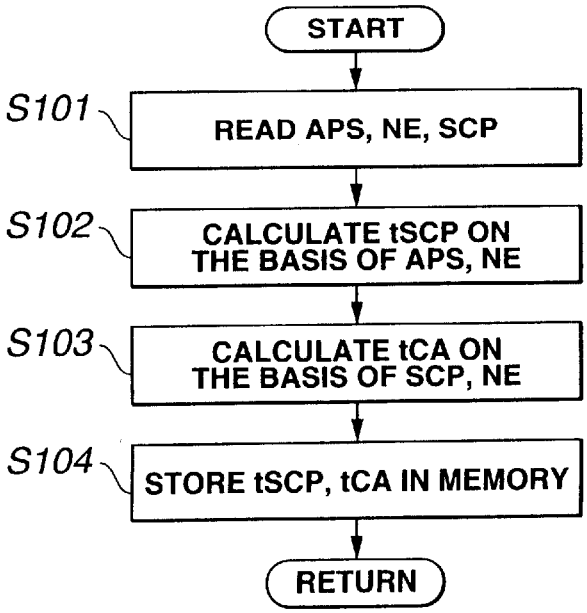
FIG. 4 is a flowchart of a process executed by the control system of FIG. 3.

FIG. 4 is a flowchart showing a process which is executed in engine control module 123 for calculating a target supercharging pressure and a target control shaft rotation angle. This process is executed repeatedly every predetermined time. Firstly, in step S101, acceleration pedal opening degree (equivalent of engine load) APS, engine speed NE and actual super charging pressure SCP at this time are read on the basis of the output of acceleration pedal opening degree sensor 120, the output of engine speed sensor 121 and the output of supercharging sensor 122, respectively.

In step S102, target supercharging pressure tSCP is calculated on the basis of acceleration pedal opening degree APS and engine speed NE. Specifically, a corresponding value to target supercharging pressure tSCP is looked up in a control map (not shown) in which target supercharging pressure tSCP is stored in a way as to correspond to acceleration pedal opening degree APS and engine speed NE. The control map is set to have such characteristics that the supercharging pressure becomes larger as the load (APS) and engine speed become higher.

In step S103, target rotation angle tCA of control shaft 42 of the variable compression ratio mechanism is calculated on the basis of actual supercharging pressure SCP and engine speed NE. Specifically, a corresponding value to target rotation angle tCA is looked up in a control map (not shown) in which target rotation angle tCA is stored in a way as to correspond to actual supercharging pressure SCP and engine speed NE. The control map is constructed so as to have such characteristics that the compression ratio becomes highest within the limits that does not cause knocking. Accordingly, a high compression ratio is obtained under a low supercharging pressure condition, and the compression ratio becomes lower as the supercharging pressure becomes higher.

In the meantime, from the consideration of the fact that a delay in variation of the actual supercharging pressure SCP in response to a variation of the target supercharging pressure tSCP is relatively large, it is not target supercharging pressure tSCP but actual supercharging pressure SCP that is used as a parameter for determining the compression ratio. This is for assuring that a variation of the compression ratio never precedes an actual variation of the supercharging pressure.

In step S104, calculated target supercharging pressure tSCP and calculated target rotation angle tCA are stored in a memory in engine control module 123.

The process in FIG. 4 is for carrying out only calculation of various target values. Actual supercharging pressure control and actual rotation angle control are performed by a supercharging pressure control process and a compression ratio control process which are not shown.

Namely, in the supercharging pressure control process, a feedback correction opening degree of exhaust bypass valve 56 corresponding to a difference between latest target supercharging pressure tSCP and latest actual supercharging pressure SCP which are stored in the memory is calculated, and a control signal representative of the correction opening degree is supplied to exhaust bypass valve 56. The correction opening degree is given so as to increase the opening degree of exhaust bypass valve 56 when tSCP>SCP and decrease the opening degree when tSCP<SCP.

Further, in the compression ratio control process, a feedback control signal corresponding to the difference between latest target rotation angle tCA and an actual rotation angle (which is detected by rotation angle sensor 102) is formed and supplied to motor 100.

Figure 5:
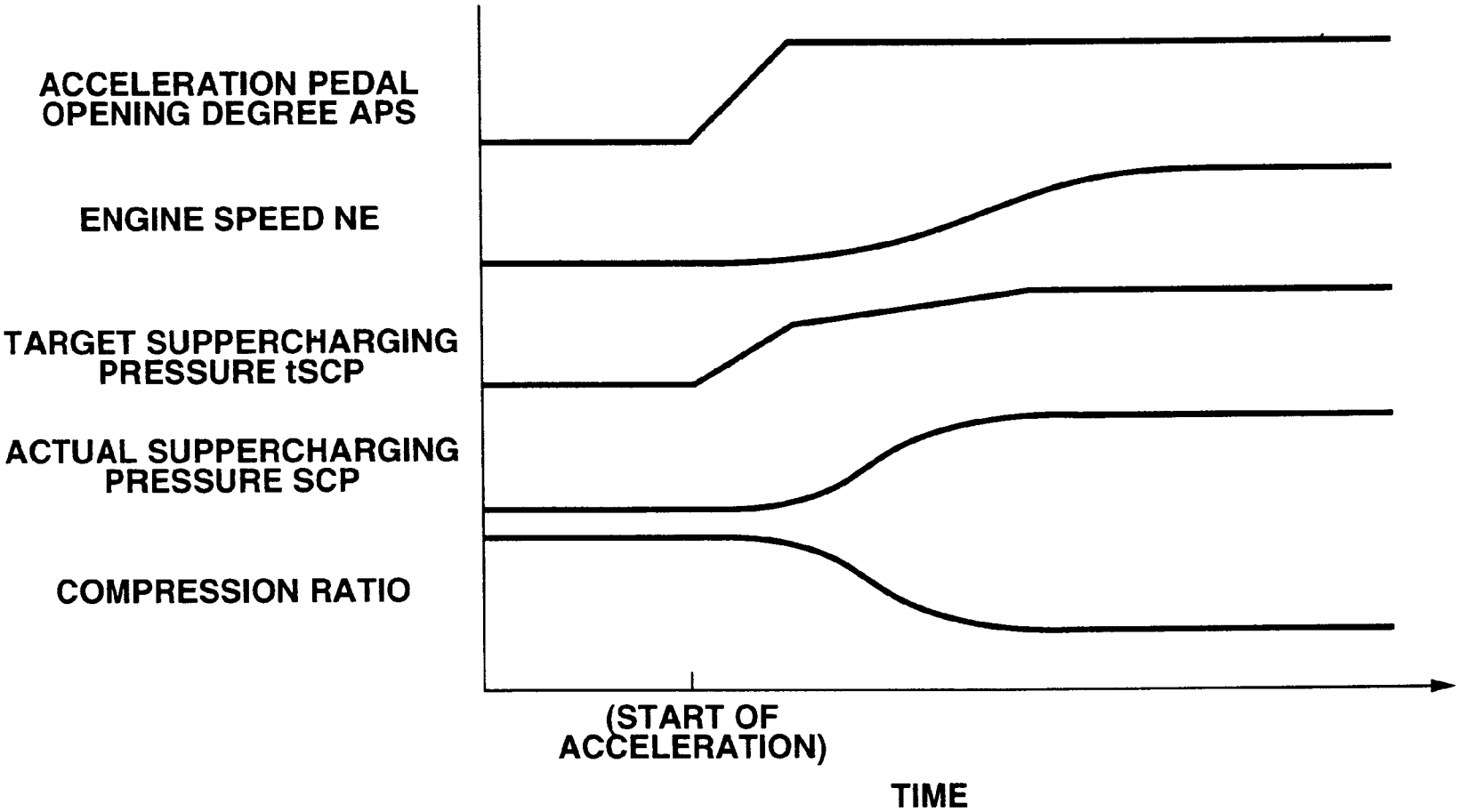
FIG. 5 is a time chart of supercharging control and compression ratio control at the time of acceleration.

FIG. 5 shows an example of a time chart of a supercharging control and a compression ratio control at the time of acceleration. As shown, as acceleration pedal opening degree APS increases, target supercharging pressure tSCP becomes higher and a little later actual supercharging pressure SCP becomes higher. In response to increase of the actual supercharging pressure, the compression ratio is lowered to avoid knocking.

In the foregoing, it will be understood that making smaller the piston speed around the top dead center causes the speed of increase of the combustion chamber volume in the range of crank angle at the first half of the expansion stroke to become smaller, thus causing a decrease of pressure within the combustion chamber within the aforesaid crank angle range to become smaller and simultaneously causing a decrease of temperature within the combustion chamber to become smaller. Accordingly, the combustion speed at the first half of the expansion stroke can be maintained larger and the burn duration can be shortened effectively. As a result, even at the time of a high load operating condition where a large amount of air is supplied to the combustion chamber by supercharging, it becomes possible to avoid a considerably large increase of exhaust gas temperature. Further, since the amount of mixture which is combusted at the first half of the expansion stroke is increased, the thermal energy can be converted to the output of the engine at an improved rate, thus making it possible to improve the thermal efficiency of the engine.

It will be further understood that when the piston speed around the top dead center is made smaller, the piston speed around the bottom dead center is caused to become larger in reverse. This means, when consideration is made on the assumption that the valve opening timing of the exhaust valve is fixed, that the exhaust valve tends to open before the piston finishes going downward. For this reason, there is a tendency of causing a little loss. However, when a turbocharger is used as a supercharger, the energy of the exhaust gas can be recovered for a turbine work of the turbocharger. Therefore, even when the combusted gas having a relatively high energy is emitted into the exhaust passage, an actual loss is small.

It will be further understood that according to the present invention it becomes possible to carry out a compression ratio control in accordance with the supercharging pressure. By this, it becomes possible to make lower the compression ratio of the engine at high load operation where the supercharging pressure is high, for thereby avoiding knocking, and make higher the compression ratio at low to middle load operation where supercharging is not performed, for thereby attaining a good fuel consumption.

It will be further understood that according to the present invention the piston crank mechanism is constructed so that the speed of the piston around the top dead center when the compression ratio is relatively low is smaller than that when the compression ratio is relatively high. This is effective for further enhancing or improving the effect of the present invention since the piston speed can be lower around the TDC when the compression ratio is low, i.e., at high load operation.

The entire contents of Japanese Patent Application P2000-165528 (filed Jun. 2, 2000) are incorporated herein by reference.

Although the invention has been described above by reference to a certain embodiment described above. Modifications and variations of the embodiment described above will occur to those skilled in the art, in light of the above teachings. The scope of the invention is defined with reference to the following claims.

What is claimed is:

1. An internal combustion engine comprising:

a piston reciprocatively movable within a cylinder of the engine;

a piston crank mechanism for converting reciprocative motion of the piston to rotation of a crankshaft; and a supercharger for supercharging the cylinder;

wherein the piston crank mechanism connects between the piston and the crankshaft so as to cause the piston to move at a speed which is smaller around a top dead center of the piston and higher around a bottom dead center of the piston as compared with respective corresponding piston speeds attained by a comparable single-link type piston crank mechanism.

2. An internal combustion engine according to claim 1, wherein the piston crank mechanism comprises a first link connected at one of opposite ends to a piston pin of the piston, a second link connecting between the other of the opposite ends of the first link and a crank pin of the crankshaft, and a third link connected at one of opposite ends to the second link and at the other of the opposite ends to a main body of the engine.

3. An internal combustion engine according to claim 1, wherein the piston crank mechanism is capable of varying a top dead center of the piston and thereby a compression ratio and comprises a control system for controlling the compression ratio in such a manner that a relatively low compression ratio is obtained when a supercharging pressure produced by the supercharger is relatively high and a relatively high compression ratio is obtained when the supercharging pressure is relatively low.

4. An internal combustion engine according to claim 3, wherein the piston crank mechanism comprises a first link connected at one of opposite ends to a piston pin of the piston, a second link connecting between the other of the opposite ends of the first link and a crank pin of the crankshaft, a third link connected at one of opposite ends to the second link and at the other of the opposite ends to a main body of the engine, and a variable pivot device for varying a pivotal position at which the third link is pivotally connected to the main body of the engine, the control system controlling the variable pivot device for varying the pivotal position of the third link in accordance with an operating condition of the engine.

5. An internal combustion engine according to claim 4, wherein the piston crank mechanism is constructed so that the speed of the piston around the top dead center when the compression ratio is relatively low is smaller than that when the compression ratio is relatively high.

6. An internal combustion engine according to claim 1, wherein the supercharger comprises a turbocharger which supercharges the cylinder by an energy of an exhaust gas of the engine.

7. An internal combustion engine comprising:

a piston reciprocatively movable within a cylinder of the engine;

a supercharger for supercharging the cylinder; and control means for controlling movement of the piston in such a manner that a piston speed is smaller around a top dead center and larger around a bottom dead center as compared with respective corresponding piston speeds attained by a comparable single-link type piston crank mechanism.

8. An internal combustion engine according to claim 7, wherein the control means comprises a piston crank mechanism including a first link connected at one of opposite ends to a piston pin of the piston, a second link connecting between the other of the opposite ends of the first link and a crank pin of the crankshaft, and a third link connected at one of opposite ends to the second link and at the other of opposite ends to a main body portion of the engine.

9. An internal combustion engine according to claim 7, wherein the control means comprises a piston crank mechanism capable of varying a compression ratio by varying a top dead center of the piston and a control system for controlling the piston crank mechanism in such a manner that a relatively low compression ratio is obtained when a supercharging pressure produced by the supercharger is relatively high and a relatively high compression ratio is obtained when the supercharging pressure is relatively low.

10. An internal combustion engine according to claim 9, wherein the piston crank mechanism comprises a first link connected at one of opposite ends to the piston, a second link connecting between the other of opposite ends of the first link and a crank pin of the crankshaft, a third link connected at one of opposite ends to the second link and at the other of opposite ends to a main body of the engine, and a variable pivot device for varying a pivotal position at which the third link is pivotally connected to the main body of the engine, the control system controlling the variable pivot device for varying the pivotal position of the third link in accordance with an operating condition of the engine.

11. An internal combustion engine according to claim 7, wherein the piston crank mechanism is constructed so that the speed of the piston around the top dead center when the compression ratio is low is smaller than that when the compression ratio is high.

12. An internal combustion engine according to claim 7, wherein the supercharger comprises a turbocharger which supercharges the cylinder by an energy of an exhaust gas of the engine.

13. An internal combustion engine comprising:

a piston reciprocatively movable within a cylinder of the engine;

a piston crank mechanism for converting reciprocative motion of the piston to rotation of a crankshaft; and a supercharger for supercharging the cylinder;

wherein the piston crank mechanism includes a pair of first and second links pivotally connected to each other and connecting between the piston and a crank pin of the crankshaft, the first and second links being constructed so as to cause the piston to move at a speed which is lower around a top dead center of the piston and higher around a bottom dead center of the piston as compared with respective corresponding speeds attained by a comparable single-link type piston crank mechanism.

14. An internal combustion engine according to claim 13, wherein the piston crank mechanism comprises means for varying an angular position of the second link and thereby varying a compression ratio of the engine.

15. An internal combustion engine according to claim 14, wherein the means for varying the angular position comprises a third link connected at one of opposite ends to the second link and at the other of the opposite ends to a main body of the engine.

16. An internal combustion engine according to claim 14, wherein the means for varying the angular position further comprises means for varying a position of the other of the opposite ends of the third link relative to the main body of the engine in accordance with an operating condition of the engine.

17. An internal combustion engine according to claim 16, wherein the means for varying the angular position further comprises a control shaft by way of which the other of the opposite ends of the third link is pivotally connected to the main body of the engine, the control shaft including a larger diameter portion supporting thereon the other of the opposite ends of the third link and a smaller diameter portion eccentric with the larger diameter portion and pivotally connected to the main body of the engine.

18. An internal combustion engine according to claim 17, wherein the means for varying the angular position further comprises a control system for variably controlling a rotational position of the control shaft and thereby a center axis of the larger diameter portion relative to the main body of the engine, in accordance with an operating condition of the engine.

19. An internal combustion engine according to claim 13, wherein the first and second links are constructed so that the speed of the piston around the top dead center when the compression ratio is low is smaller than that when the compression ratio is high.

* * * * *